US008330568B2

(12) United States Patent
Konoue et al.

(10) Patent No.: US 8,330,568 B2
(45) Date of Patent: Dec. 11, 2012

(54) MULTILAYER COIL COMPONENT AND METHOD FOR MANUFACTURING THE SAME

(75) Inventors: Masaharu Konoue, Tokyo-to (JP); Yukio Maeda, Shiga-ken (JP); Tatsuya Mizuno, Shiga-ken (JP); Hiroki Hashimoto, Shiga-ken (JP); Mitsuru Ueda, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/911,518

(22) Filed: Oct. 25, 2010

(65) Prior Publication Data

US 2011/0037557 A1 Feb. 17, 2011

Related U.S. Application Data

(63) Continuation of application No. PCT/JP2009/057444, filed on Apr. 13, 2009.

(30) Foreign Application Priority Data

Apr. 28, 2008 (JP) ..... 2008-117048

(51) Int. Cl.
*H01F 27/24* (2006.01)
*H01F 5/00* (2006.01)
*H01F 7/06* (2006.01)

(52) U.S. Cl. ..... 336/233; 336/200; 336/234; 29/602.1

(58) Field of Classification Search ..... 336/200, 336/223, 233, 234; 29/602.1
See application file for complete search history.

(56) References Cited

U.S. PATENT DOCUMENTS 5,126,707 A * 6/1992 Ikeda ..... 333/185
7,719,398 B2 * 5/2010 Tsuzuki ..... 336/200
2003/0102951 A1 * 6/2003 Nakano et al. ..... 336/200
(Continued)

FOREIGN PATENT DOCUMENTS

JP 04-065807 3/1992
(Continued)

OTHER PUBLICATIONS

Office Action from Korean Intellectual Property Office dated Aug. 23, 2011; Korean Patent Application No. 2010-7017968 with abstract.

(Continued)

*Primary Examiner* — Mohamad Musleh
*Assistant Examiner* — Mangtin Lian
(74) *Attorney, Agent, or Firm* — Studebaker & Brackett PC; Tim L. Brackett, Jr.; John F. Guay

(57) ABSTRACT

A multilayer coil component includes internal conductors made of silver (Ag) having metal films provided on surfaces thereof to suppress migration of Ag contained in the internal conductors and/or relieve internal stress between magnetic ceramic layers and internal conductor layers without forming gaps at interfaces between the internal conductors including the metal films and a magnetic ceramic surrounding the internal conductors and the interfaces between the internal conductors and the magnetic ceramic. In a manufacturing method for forming a multilayer coil, an acidic solution containing a metal is allowed to penetrate a magnetic ceramic through side surfaces thereof and side gap sections that are regions between side portions of internal conductors and the side surfaces to reach the interfaces between the internal conductors and a surrounding magnetic ceramic, whereby the metal is deposited on surfaces of the internal conductors.

14 Claims, 4 Drawing Sheets

U.S. PATENT DOCUMENTS

| | | | | |
|---|---|---|---|---|
| 2004/0084131 | A1* | 5/2004 | Konoue et al. | 156/89.11 |
| 2008/0012679 | A1* | 1/2008 | Okabe et al. | 336/200 |

FOREIGN PATENT DOCUMENTS

| | | | |
|---|---|---|---|
| JP | 04-192403 | | 7/1992 |
| JP | 04-317302 | | 11/1992 |
| JP | 07-240334 | | 9/1995 |
| JP | 08-083715 | | 3/1996 |
| JP | 2000-181832 | | 6/2000 |
| JP | 2001-052930 | | 2/2001 |
| JP | 2001-244116 | | 9/2001 |
| JP | 2002-217038 | | 8/2002 |
| JP | 2004-022798 | | 1/2004 |
| KR | 10-2001-0067050 | | 7/2001 |
| WO | WO2006/073092 | A1 * | 7/2006 |
| WO | 2009/034824 | | 3/2009 |

OTHER PUBLICATIONS

Japanese Office Action "Notificaion of Reasons for Rejection" dated Mar. 27, 2012; Japanese Patent Application No. 2010-510076; with translation.

* cited by examiner

MULTILAYER COIL COMPONENT AND METHOD FOR MANUFACTURING THE SAME

CROSS REFERENCE TO RELATED APPLICATIONS

The present application is a continuation of International Application No. PCT/JP2009/057444 filed Apr. 13, 2009, which claims priority to Japanese Patent Application No. 2008-117048 filed Apr. 28, 2008, the entire contents of each of these applications being incorporated herein by reference in their entirety

TECHNICAL FIELD

The invention relates to a multilayer coil component including a magnetic ceramic element including a helical coil, and to a method for manufacturing the multilayer coil component.

BACKGROUND

In recent years, there have been increasing demands for compact electronic components. The mainstream of coil components is shifting to a multilayer type which is suitable for size reduction.

Multilayer coil components obtained by co-firing magnetic ceramics and internal conductors have a problem that the internal stress caused by differences in thermal expansion coefficient between magnetic ceramic layers and internal conductor layers. These differences in thermal expansion coefficient can reduce magnetic properties of the magnetic ceramics, which can cause a reduction in impedance of the multilayer coil components and differences in impedance between the multilayer coil components.

In order to solve such a problem, an element proposed in Japanese Unexamined Patent Application Publication No. 2004-22798 ("Patent Document 1") includes a multilayer impedance element in which a reduction or variation in impedance is prevented in such a manner that gaps, or openings are provided between magnetic ceramic layers and internal conductor layers. These gaps are formed by immersing a fired magnetic ceramic element in an acidic plating solution and the effect of stress due to the internal conductor layers on the magnetic ceramic layers is thereby eliminated. In the multilayer impedance element disclosed in Patent Document 1, the fired magnetic ceramic element is immersed in the plating solution, so that the plating solution penetrates the magnetic ceramic element through zones where the internal conductor layers are exposed at surfaces of the magnetic ceramic element, whereby the gaps are intermittently formed between the magnetic ceramic layers and the internal conductor layers. The formation of the gaps between the magnetic ceramic layers and the internal conductor layers causes the internal conductor layers to be thin; hence, the reduction of the percentage of each internal conductor layer in a space between the magnetic ceramic layers cannot be avoided.

Therefore, there is a problem in that the manufacture of products having low direct-current resistance is difficult. In particular, a compact product such as a product with a size of 1.0 mm×0.5 mm×0.5 mm or a product with a size of 0.6 mm×0.3 mm×0.3 mm needs to include thin magnetic ceramic layers. It is difficult with internal conductor layers and gaps provided between the magnetic ceramic layers, and with the internal conductor layers formed so as to have a large thickness. Therefore, there is a problem in that a reduction in direct-current resistance cannot be achieved or sufficient reliability cannot be secured because the internal conductor layers are likely to be broken by surges.

SUMMARY

The inventions provide a multilayer coil component having high reliability and a method of manufacturing a multilayer coil component.

A multilayer coil component consistent with the claimed invention includes plural internal conductors made of Ag provided between adjacent magnetic ceramic layers and interconnected to each other to form a helical coil surrounded by magnetic ceramic. Metal films are present on surfaces of the internal conductors. No gaps are present at interfaces between the internal conductors including the metal films and the surrounding magnetic ceramic. The interfaces between the internal conductors and the magnetic ceramic are separated.

According to a more specific embodiment consistent with the claimed invention, the metal films present on the surfaces of the internal conductors are preferably distributed in such a state that pores present in the magnetic ceramic layers around the internal conductors are filled with the metal films.

In yet another more specific embodiment, the magnetic ceramic may be made of NiCuZn ferrite.

According to a more specific exemplary embodiment, the magnetic ceramic may contain low-softening point zinc borosilicate glass having a softening point of 500° C. to 700° C.

According to another more specific exemplary embodiment, a metal contained in the metal films may be Ag that is the same as a metal contained in the internal conductors or at least one selected from the group consisting of Ni, Pd, Au, Cu, and Sn that are dissimilar metals.

In another more specific exemplary embodiment, the metal contained in the metal films may have a thermal expansion coefficient that is less than that of Ag contained in the internal conductors and is greater than that of a magnetic material contained in the magnetic ceramic layers.

In yet another more specific exemplary embodiment, the multilayer coil component may further include external electrodes and plating layers disposed on the internal conductors, the external electrodes being disposed on surfaces of the magnetic ceramic element and being electrically connected to the internal conductors. The metal contained in the metal films may be the same as a metal contained in at least one portion of each plating layer.

In a process for manufacturing a multilayer coil component consistent with the claimed invention, where the multilayer coil component includes plural internal conductors made of Ag provided between adjacent magnetic ceramic layers and interconnected to each other to form a helical coil surrounded by magnetic ceramic, the process includes forming the magnetic ceramic such that portions of the magnetic ceramic that are located in side gap sections of the magnetic ceramic that are regions between side portions of the internal conductors forming the helical coil and side surfaces of the magnetic ceramic have a pore area percentage of 6% to 20%. The process includes allowing an acidic solution containing a metal to penetrate a magnetic ceramic through side surfaces of the magnetic ceramic and the side gap sections such that the acidic solution reaches interfaces between the internal conductors and the surrounding magnetic ceramic. The penetrating acidic solution containing the metal deposits the metal on surfaces of the internal conductors.

DETAILED DESCRIPTION

Features of the present invention will now be described in detail with reference to exemplary embodiments consistent with the claimed invention.

EXAMPLE 1

Figure 1:
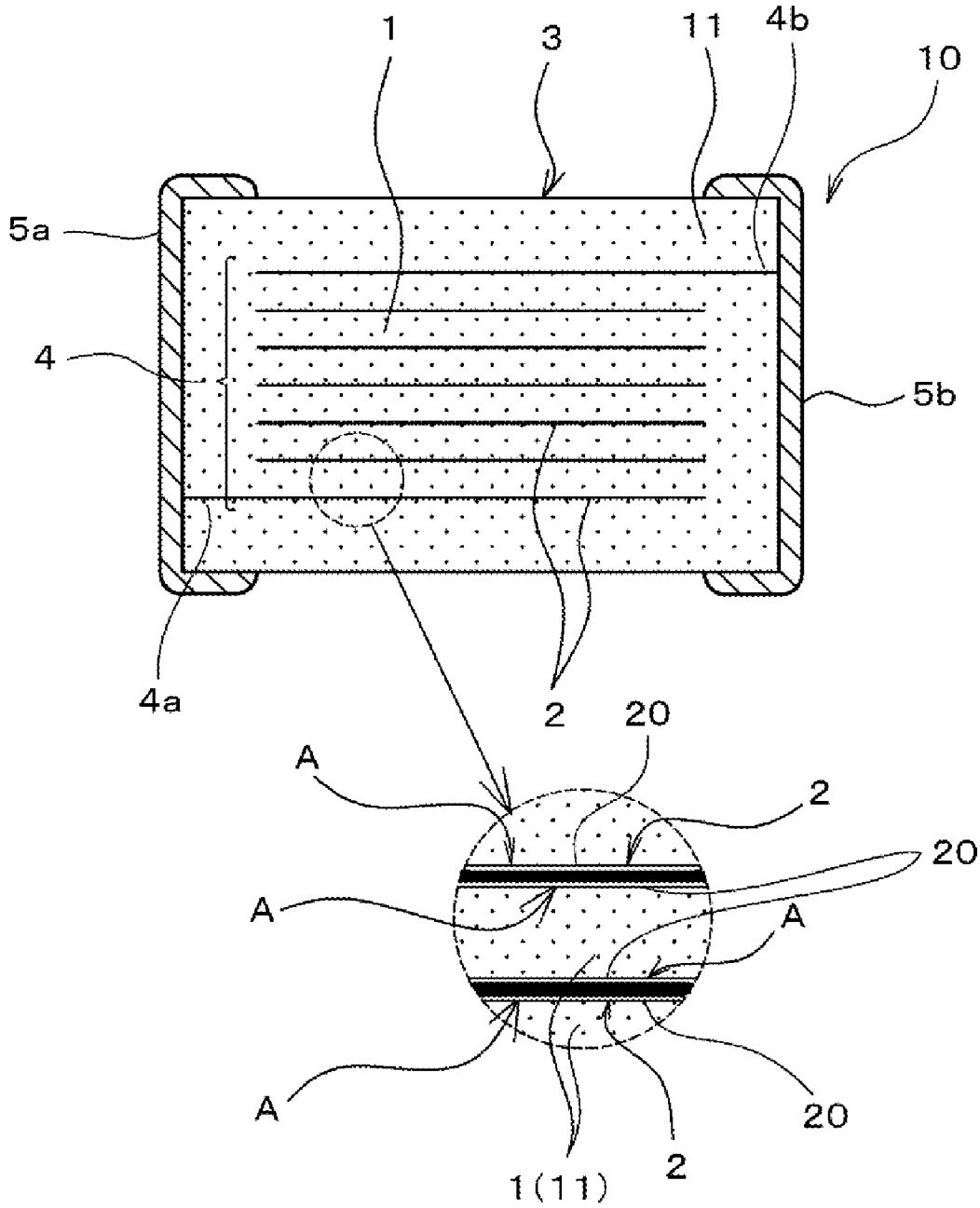
FIG. 1 is a front sectional view showing the configuration of a multilayer coil component according to an exemplary embodiment.
Figure 2:
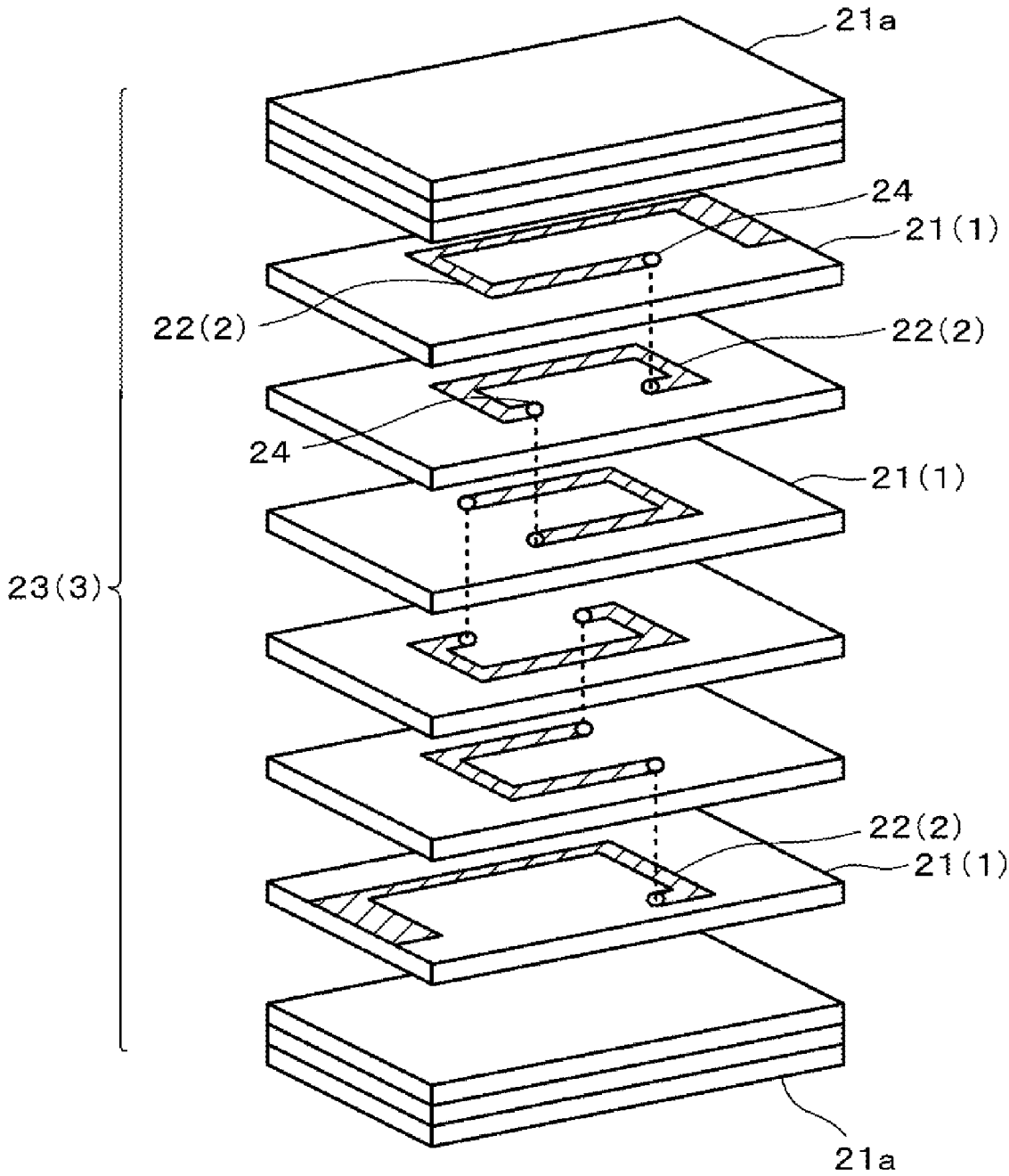
FIG. 2 is an exploded perspective view showing the configuration of a substantial part of the multilayer coil component shown in FIG. 1.

FIG. 1 is a sectional view of a multilayer coil component (a multilayer impedance element in this example) according to an exemplary embodiment. FIG. 2 is an exploded perspective view of a substantial part thereof.

The multilayer coil component 10 includes a magnetic ceramic element 3 including a helical coil 4 formed by interlayer-connecting internal conductors 2 to each other, the internal conductors 2 being arranged between magnetic ceramic layers (NiCuZn ferrite layers in this example) 1 and being made of Ag.

A pair of external electrodes 5*a* and 5*b* are arranged on end portions of the magnetic ceramic element 3 so as to be electrically connected to end portions 4*a* and 4*b* of the helical coil 4.

In the multilayer coil component 10, metal films (Ni films in this example) 20 are distributed on surfaces of the internal conductors 2, no gaps, or openings are present at interfaces A between the internal conductors 2 including the metal films 20 and a magnetic ceramic 11, and the internal conductors 2 including the metal films 20 are substantially in contact with the magnetic ceramic 11 as schematically shown in FIG. 1. The internal conductors 2 and the magnetic ceramic 11 are arranged and the metal films 20 and the magnetic ceramic 11 are arranged such that the interfaces A are separated.

In the multilayer coil component 10, the internal conductors 2 including the metal films 20 and the magnetic ceramic 11 are arranged such that the interfaces A are separated; hence, gaps for breaking the bond between the internal conductors 2 including the metal films 20 and the magnetic ceramic 11 need not be provided at the interfaces A. Therefore, the internal conductors are prevented from being thinned by providing gaps and the multilayer coil component 10 can be prepared so as to have reduced stress and high reliability.

A multilayer coil component according to embodiments includes a magnetic ceramic element including a helical coil formed by interlayer-connecting internal conductors to each other, the internal conductors being arranged between magnetic ceramic layers and being made of Ag. In the multilayer coil component, no gaps are present at interfaces between the internal conductors including metal films and a magnetic ceramic surrounding the internal conductors, the interfaces between the internal conductors and the magnetic ceramic are separated, and the metal films are present on surfaces of the internal conductors. This is capable of reducing the internal stress caused by the difference in firing shrinkage behavior between the internal conductors and the magnetic ceramic or by differences in thermal expansion coefficient therebetween without forming any gaps between the internal conductors and the magnetic ceramic. Therefore, the following components can be provided: multilayer coil components which have small differences between properties and high reliability, which can be reduced in direct-current resistance, and in which internal conductors can be suppressed or prevented from being broken by surges or the like.

According to embodiments, a multilayer coil component includes magnetic ceramic layers and internal conductor layers and can solve a problem relating to the internal stress caused by the difference in firing shrinkage behavior between the magnetic ceramic layers and the internal conductor layers or by differences in thermal expansion coefficient therebetween without forming conventional gaps (openings) between the magnetic ceramic layers and the internal conductor layers. Furthermore, the migration of Ag contained in the internal conductors can be suppressed.

The term "metal film" as used herein is not limited to a so-called layer or thin film covering a predetermined region with no space therebetween and can encompass a wide concept including a state in which metal materials are scattered at certain intervals or arranged in a large number of spaces.

The metal films can be formed using a metal which is different from Ag contained in the internal conductors and that is unlikely to migrate such that surfaces of the internal conductors are covered with the metal films, which can suppress or prevent the migration of Ag contained in the internal conductors and enhance reliability.

Exemplary metals for the metal films that are less likely to migrate than Ag include Cu, Sn, and Au. The order of the migration rate of these materials is as follows: Ag>Cu>Sn>Au (Yuji Kimura at Kogakuin University, Ichiro Takano at Kogakuin University, Kikuya Narusawa at Photo Precision Co., Ltd., Kiyomi Shirai at Photo Precision Co., Ltd., and Makoto Iwashita at Photo Precision Co., Ltd., IT Sangyou wo sasaeru Koukinou Zairyou no Kaihatsu/Koukinou Hakumaku no Sousei to sono Tokusei oyobi Shinraisei no Hyouka).

According to embodiments, the metal films are distributed in such a state that pores present in the magnetic ceramic layers around the internal conductors are filled with the metal films; hence, effects such as the relief of internal stress and the suppression of the migration of Ag contained in the internal conductors can be enhanced. Furthermore, multilayer coil components having high reliability can be obtained without using an expensive fine particle material as a ceramic material and economically efficient multilayer coil components.

Additionally, use of magnetic ceramics such as NiCuZn ferrite is effective in obtaining multilayer coil components having high reliability and high magnetic permeability. For example, use of a magnetic ceramic made of NiCuZn ferrite and containing low-softening point zinc borosilicate glass having a softening point of 500° C. to 700° C. is effective in obtaining multilayer coil components having high reliability and high properties because they can be fired at a low-temperature instead of high-temperature.

The use of low-softening point zinc borosilicate glass allows the sintered density of the magnetic ceramic to be stabilized because low-softening point zinc borosilicate glass is crystallized glass. When the magnetic ceramic contains 0.1 to 0.5 weight percent low-softening point zinc borosilicate glass or 0.2 to 0.4 weight percent low-softening point zinc borosilicate glass, the above effect can be enhanced.

A metal contained in the metal films may be Ag, which is the same as a metal contained in the internal conductors, or may be a metal dissimilar from Ag. Examples of dissimilar metal may be at least one selected from the group consisting of Ni, Pd, Au, Cu, and Sn.

When the metal contained in the metal films has a thermal expansion coefficient that is less than that of Ag contained in the internal conductors, and the coefficient is greater than that of a magnetic material contained in the magnetic ceramic layers, the use of the metal allows interfaces between the internal conductors and the magnetic ceramic to have a stepwise gradient in linear expansion coefficient and therefore is effective in efficiently suppressing stress from being caused by differences in thermal expansion coefficient between the internal conductors and the magnetic ceramic. Therefore, the following components can be provided: multilayer coil components having good resistance to thermal shock caused in a step of mounting each multilayer coil component on a printed circuit board or in a usage environment.

Sn, Ag, Cu, Au, Ni, and Pd, which are cited as examples of a material contained in the metal films in embodiments of a multilayer coil component consistent with the claimed invention, have a corresponding one of the following linear expansion coefficient values (reference: Kikai Sekkei Binran, Maruzen): Sn: 23.0×10-6/K, Ag: 19.7×10-6/K, Cu: 16.5×10-6/K, Au: 14.2×10-6/K, Ni: 12.3×10-6/K, and Pd: 11.8×10-6/K. NiCuZn ferrite, which is cited as an example of a material contained in the magnetic ceramic in the present invention, has a linear expansion coefficient of 10×10-6/K. The comparison in linear expansion coefficient between these metals and NiCuZn ferrite is as follows: Sn>Ag>Cu>Au>Ni>Pd>NiCuZn ferrite. That is, these metals have a linear expansion coefficient greater than the linear expansion coefficient of NiCuZn ferrite, which is cited as a preferred example of the magnetic ceramic in the present invention.

Among these metals are Pd, Ni, Au, and Cu, which have a respective thermal expansion coefficient that is less than that of Ag contained in the internal conductors, and which is greater than that of NiCuZn ferrite cited as a preferred example of the magnetic ceramic. Thus, use of at least one of Pd, Ni, Au, and Cu is preferred in applications that require a thermal expansion coefficient of the metal films to be less than Ag contained in the internal conductors and greater than the thermal expansion coefficient of the magnetic ceramic (e.g., NiCuZn). In terms of linear expansion coefficient, Pd, Ni, Au, and Cu can be specified as metals particularly suitable for forming the metal films.

Sn has a linear expansion coefficient that is greater than that of NiCuZn ferrite, which is cited as a preferred example of the magnetic ceramic, and is greater than that of Ag contained in the internal conductors. Therefore, Sn cannot allow the interfaces between the internal conductors and the magnetic ceramic to have a stepwise gradient in linear expansion coefficient. In this respect, Sn is inferior in application to Pd, Ni, Au, and Cu. However, Sn is a metal less likely to migrate than Ag contained in the internal electrodes and therefore is included in examples of a material useful in forming the metal films in some embodiments consistent with the claimed invention.

With embodiments of a the multilayer coil component further including external electrodes and plating layers disposed on the internal conductors, the external electrodes being disposed on surfaces of the magnetic ceramic element and being electrically connected to the internal conductors, and the metal contained in the metal films is the same as a metal contained in at least one portion (for example, a sub-layer in the case where the plating layers each have a plurality of sub-layers) of each plating layer, the internal stress caused by the difference in firing shrinkage behavior between the internal conductors and the magnetic ceramic, or internal stress caused by differences in thermal expansion coefficient therebetween, can be relieved without requiring any special step in such a manner that the magnetic ceramic element is impregnated with a plating solution in a step of plating the external electrodes and the metal films are deposited on the surfaces of the internal conductors. Therefore, multilayer coil components having high reliability can be efficiently manufactured without causing an increase in cost.

A method for manufacturing the multilayer coil component 10 according to an exemplary embodiment is described next.

(1) Preparation of Green Ceramic Sheets

Fe2O3, ZnO, NiO, and CuO were weighed at a ratio of 48.0 mole percent to 29.5 mole percent to 14.5 mole percent to 8.0 mole percent to prepare ceramic raw materials. The ceramic raw materials were wet-mixed for 48 hours in a ball mill.

Slurry prepared by wet mixing was dried with a spray dryer and then calcined at 700° C. for two hours.

The obtained calcine was wet-pulverized for 16 hours in a ball mill and then mixed with a predetermined amount of a binder to obtain a ceramic slurry.

The ceramic slurry was sheeted to prepare green ceramic sheets to be fired into magnetic ceramic layers having a thickness of 25 μm.

(2) Formation of Internal Conductor Patterns

After via-holes were formed at predetermined positions on the green ceramic sheets, a conductive paste for forming the internal conductors was applied to the green ceramic sheets by printing to form coil patterns (internal conductor patterns).

The conductive paste used was one prepared by mixing varnish, a solvent, and an Ag powder containing 0.1 weight percent or less of impurity elements and had an Ag content of 85 weight percent. The conductive paste, which was used to form the coil patterns (internal conductor patterns), preferably has a high Ag content, particularly an Ag content of, for example, 83 to 89 weight percent. When the amount of impurities is large, the internal conductors are corroded by an acidic solution. This may cause the problem of an increase in direct-current resistance.

(3) Preparation of Unfired Magnetic Ceramic Element

As schematically shown in FIG. 2, a plurality of green ceramic sheets 21, to be fired into magnetic ceramic layers 1, having internal conductor patterns 22 to be fired into internal conductors 2 were stacked and then pressed. Internal conductor pattern-free green ceramic sheets 21*a* were deposited on the upper surface and lower surface of the stack and then pressed with a pressure of 1000 kgf/cm2, whereby a laminate 23 to be fired into a magnetic ceramic element 3 was obtained.

The laminate 23 includes a helical coil formed by connecting the internal conductor patterns (coil patterns) 22 to each other through via-holes 24. The number of turns of the coil was 7.5.

(4) Preparation of Magnetic Ceramic Element

The laminate 23, which was a pressed block, was cut so as to have a predetermined size, degreased, and then sintered at various firing temperatures between 820° C. and 910° C. to obtain the magnetic ceramic element 3 including the helical coil 4.

Figure 3:
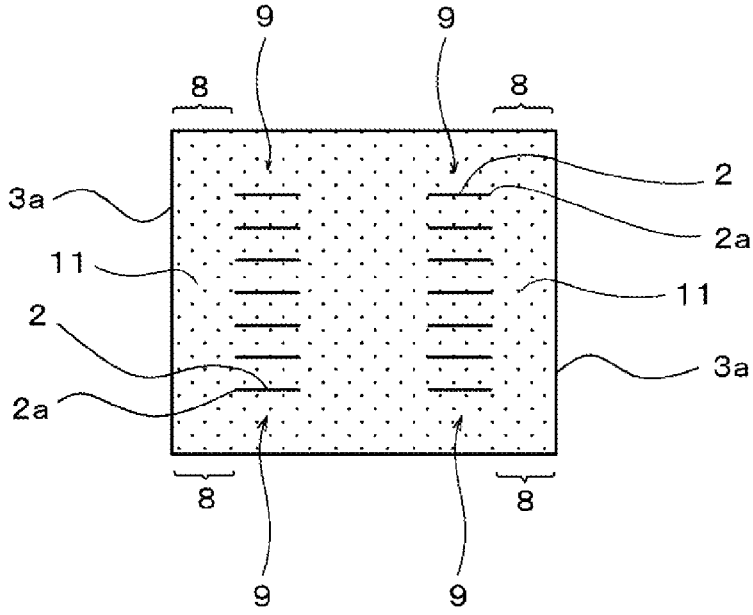
FIG. 3 is a side sectional view showing the configuration of the multilayer coil component according to the example of the present invention.

In this exemplary embodiment, the following portions had a pore area percentage of 11%: portions of the magnetic ceramic 11 that were located in side gap sections 8 (see FIG. 3) of the magnetic ceramic element 3 that were regions between side portions 2*a* of the internal conductors 2 forming the helical coil 4 and side surfaces 3*a* of the magnetic ceramic element 3.

This is because the pore area percentage of the portions of the magnetic ceramic 11 that are located in the side gap sections 8 is preferably within a range from 6% to 20% in order to the form metal films 20 in such a manner that an acidic solution containing a metal is allowed to penetrate the magnetic ceramic element 3 through side surfaces thereof to reach interfaces between the internal conductors 2 and the surrounding magnetic ceramic 11 and the metal is deposited on surfaces of the internal conductors 2.

In this exemplary embodiment, in order to adjust the pore area percentage of the portions of the magnetic ceramic 11 that are located in the side gap sections 8 to 11%, the shrinkage of the internal conductors 2 was adjusted to be less than the shrinkage of the magnetic ceramic 11, that is, the sintering shrinkage of the internal conductors 2 was particularly adjusted to 8% and the distribution of the pore area percentage was created in the magnetic ceramic element 3 by firing at a predetermined temperature. That is, the pore area percentage of the side gap sections 8 was adjusted to be greater than the pore area percentage of a region 9 between the upper surface of the uppermost internal conductor 2 in the magnetic ceramic element 3 and the upper surface of the magnetic ceramic element 3 and a region 9 between the lower surface of the lowermost internal conductor 2 and the lower surface of the magnetic ceramic element 3.

The shrinkage of the magnetic ceramic contained in the ceramic element during firing is greater than the shrinkage of the internal conductors. Therefore, regions of the magnetic ceramic that are located near the upper and lower surfaces of the ceramic element and that contain none of the internal conductors shrink greatly; however, regions containing the internal conductors shrink slightly. Thus, the side gap sections have a large pore area percentage.

Since the sintering shrinkage of the internal conductors 2 including the metal films 20 is less than that of the magnetic ceramic 11 at a predetermined proportion, the internal conductors 2 can suppress the sintering shrinkage of the magnetic ceramic 11.

The sintering shrinkage of the internal conductors can be controlled in such a manner that the content of a conductive component (the Ag powder) in the conductive paste for forming the internal conductors and the type of the varnish and that of the solvent contained in the conductive paste are appropriately selected.

When the sintering shrinkage of the internal conductors is less than 0%, the internal conductors do not shrink but expand during firing to cause structural defects and/or negatively affect the shape of a chip, which is not preferred.

When the sintering shrinkage of the internal conductors is greater than 15%, the pore area percentage of the side gap sections 8 is extremely small and therefore a Ni plating solution cannot penetrate side gaps.

Thus, the sintering shrinkage of the internal conductors is preferably within a range from 0% to 15% and more preferably 5% to 11%.

The fired magnetic ceramic element was measured for pore area percentage in such a manner that a cross section (hereinafter referred to as "W-T surface") of the magnetic ceramic element that was defined by the width (W) direction and thickness (T) direction of the magnetic ceramic element was mirror-polished, subjected to focused ion beam processing (FIB processing), and then observed with a scanning electron microscope (SEM).

In particular, the pore area percentage was measured with an image-processing software program, "WINROOF" (Mitani Corporation). A particular measurement method is as described below.

FIB system: FIB200TEM manufactured by FEI

FE-SEM (scanning electron microscope): JSM-7500FA manufactured by JOEL Ltd.

WinROOF (image-processing software program): Ver. 5.6 developed by Mitani Corporation

[Focused Ion Beam Processing (FIB Processing)]

Figure 4:
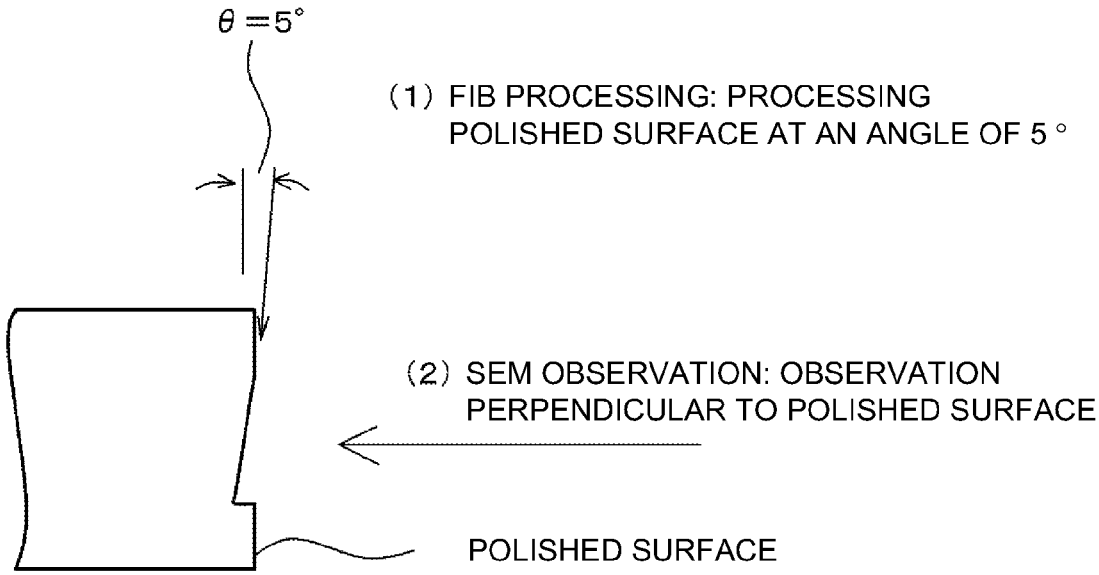
FIG. 4 is an illustration showing a method for measuring the pore area percentage of a fired magnetic ceramic element used in the example of the present invention.

As shown in FIG. 4, the polished surface of the sample that was mirror-polished as described above was subjected to FIB processing at an incident angle of 5°.

[Observation with Scanning Electron Microscope (SEM)]

SEM observation was performed under the following conditions: Acceleration voltage: 15 kV; Sample inclination: 0°; Signal: secondary electrons; Coating: Pt; and Magnification: 5000 times.

[Calculation of Pore Area Percentage]

The pore area percentage was determined by the following method: (a) A measurement region is determined. When the region is too small, errors arise depending on measurement positions. (In this example, the size was set to 22.85 μm×9.44 μm.) (b) When it is difficult to distinguish the magnetic ceramic from pores, brightness and/or contrast is adjusted. (c) Only the pores are extracted by binarization. When the pores cannot be completely extracted by "Color Extraction" in the image-processing software program WinROOF, manual correction is performed. (d) When something other than the pores has been extracted, something other than the pores is deleted. (e) The total area, number, and area percentage of the pores and the measurement region are determined by "Total Area/Number Measurement" in the image-processing software program.

In some embodiments, the pore area percentage is a value determined as described above.

The sintering shrinkage of the magnetic ceramic was measured in such a manner that the green ceramic sheets were stacked and then pressed under the same conditions as those used to manufacture the multilayer coil component and the stack was cut so as to have a predetermined size and then measured for sintering shrinkage in the stacking direction with a thermomechanical analyzer (TMA).

The sintering shrinkage of the internal conductors was measured by a method below.

The conductive paste for forming the internal conductors is applied onto a glass plate and then dried and dry matter was collected and then pulverized into powder using a mortar. The powder was put in a mold and then uniaxially press-molded under the same conditions as those used to manufacture the multilayer coil component and the molding was cut so as to have a predetermined size, fired, and then measured for sintering shrinkage in the pressing direction.

(5) Formation of External Electrodes

A conductive paste for forming the external electrodes was applied to both end portions of the magnetic ceramic element (sintered element) 3 including the helical coil 4 prepared as described above, dried, and then baked at 750° C., whereby the external electrodes 5*a* and 5*b* were formed (see FIG. 1).

The external electrode-forming conductive paste was one prepared by mixing an Ag powder with an average particle size of 0.8 w, a B—Si—K glass frit having good plating resistance and an average particle size of 1.5 w, varnish, and a solvent. The external electrodes, which were formed by baking this conductive paste, were dense and were hardly corroded by a plating solution in a plating step below.

(6) Plating Treatment of External Electrodes

The magnetic ceramic element 3 including the external electrodes 5*a* and 5*b* was subjected to Ni plating, whereby a Ni plating sub-layer (lower plating sub-layer) was formed on each of the external electrodes 5*a* and 5*b* and the metal films 20 were deposited on the internal conductors 2.

A Sn plating sub-layer was formed on the Ni plating sub-layer by performing Sn plating, whereby a plating film having a two-layer structure including the Ni plating sub-layer (lower plating sub-layer) and the Sn plating sub-layer (upper plating sub-layer) was formed on each of the external electrodes.

A Ni plating solution used for Ni plating was a plating solution (an acidic solution, having a pH of 4, containing about 300 g/L nickel sulfate, about 50 g/L nickel chloride, and about 35 g/L boric acid) in which nickel sulfate and nickel chloride were Ni sources. The Ni plating sub-layers were formed on the external electrodes in such a manner that Ni electroplating was performed at a cathode current density of 0.30 (A/dm2) for 60 minutes.

A Sn plating solution used for Sn plating was a plating solution (an acidic solution, having a pH of 5, containing about 70 g/L tin sulfate, about 100 g/L ammonium hydrogen citrate, and about 100 g/L ammonium sulfate) in which stannous sulfate was a Sn source. The Sn plating sub-layers were formed on the Ni plating sub-layers in such a manner that Sn electroplating was performed at a current density of 0.14 (A/dm2) for 60 minutes.

This provides the multilayer coil component (multilayer impedance element) 10 including the magnetic ceramic element 3 including the helical coil 4 formed by interlayer-connecting the internal conductors 2 having the metal films 20 distributed thereon as shown in FIG. 1.

(7) Evaluation

Figure 5:
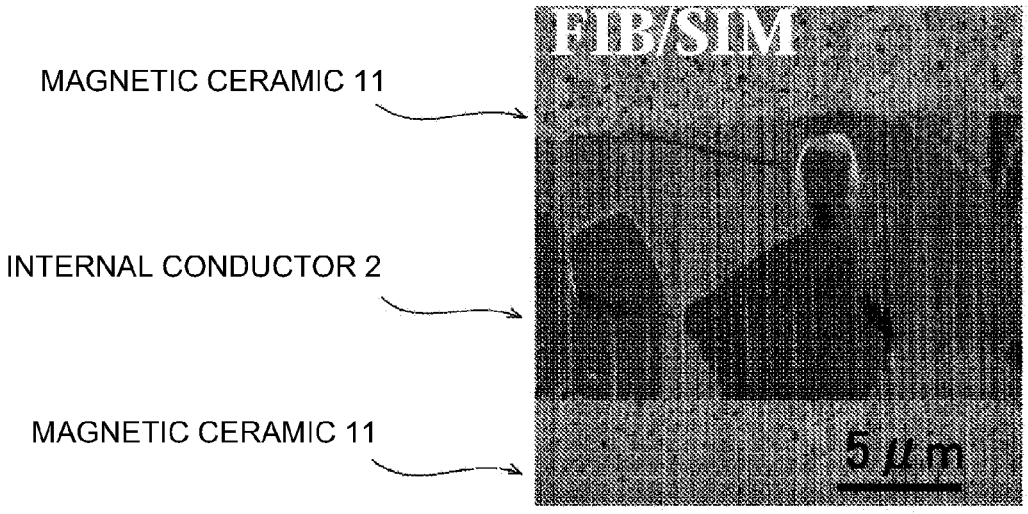
FIG. 5 is an illustration showing a SIM image of a surface (W-T surface) of the multilayer coil component according to an exemplary embodiment, the surface being mirror-polished and then subjected to FIB processing.

FIG. 5 shows a SIM image of a cross section (W-T surface) of the multilayer coil component, manufactured as described above, according to the exemplary embodiment, the cross section being mirror-polished and then subjected to focused ion beam processing (FIB processing).

The SIM image is one obtained by observing the W-T surface of the plated multilayer coil component at a magnification of 5000 times, the W-T surface being mirror-polished and then processed with an FIB, and shows that no gaps are present at the interfaces between the magnetic ceramic and the internal conductors.

Figure 6:
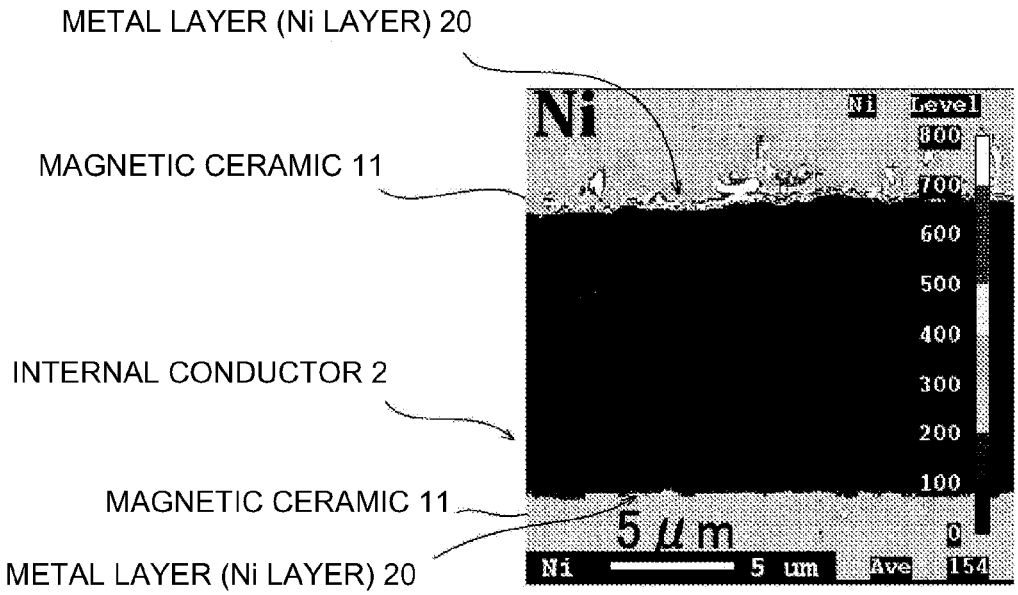
FIG. 6 is a mapping image of Ni films (metal films) on a surface of an internal conductor, the mapping image being obtained by analyzing the multilayer coil component according to an exemplary embodiment by FE-WDX (wavelength dispersive X-ray detection).

FIG. 6 is a mapping image of Ni films (metal films) on a surface of one of the internal conductors, the mapping image being obtained by analyzing the multilayer coil component according to the exemplary embodiment by FE-WDX (wavelength dispersive X-ray detection).

As shown in FIG. 6, the metal films (Ni films) 20 are dispersed to cover surfaces of this internal conductor 2. Since the metal films 20 are present on the surfaces of the internal conductors 2, the migration of Ag contained in the metal films 20 is suppressed. This allows the multilayer coil component to have high reliability.

Since the internal conductors 2, which are made of Ag, are covered with the metal films 20, which are made of N and Ni (12.3×10-6/K) has a linear expansion coefficient that is less than that of Ag (19.7×10-6/K) and is greater than that of the magnetic ceramic 11, a gradient in linear expansion coefficient is formed and therefore the change in stress of the interfaces between the internal conductors 2 and the magnetic ceramic 11 are suppressed. This allows the multilayer coil component to have good thermal shock resistance and high reliability.

In this example, the metal films 20 are formed on surfaces of the internal conductors 2 in the step of plating the external electrodes 5*a* and 5*b*. Therefore, the multilayer coil component can be efficiently manufactured so as to have good thermal shock resistance and high reliability.

In this example, the metal films 20 are formed on surfaces of the internal conductors 2 simultaneously with the plating treatment of the external electrodes 5*a* and 5*b*. The formation of the metal films 20 on the internal conductors 2 and the formation of the plating layers on the external electrodes 5*a* and 5*b* may be performed in different steps.

In this example, a metal contained in the metal films 20 is the same as a metal (Ni) used to form the plating layers on the external electrodes 5*a* and 5*b* as described above. The metal contained therein may be Ag that is the same as a metal contained in the internal conductors.

Usable dissimilar metals include various metals such as Pd, Au, Cu, and Sn in addition to Ni, which is used in this example. A metal that is less likely to migrate than Ag contained in the internal conductors is preferably used.

In a method for manufacturing the multilayer coil component according to exemplary embodiments, the magnetic ceramic element can be formed such that side gap sections of the magnetic ceramic element have a pore area percentage of 6% to 20% and an acidic solution containing a metal is allowed to reach the interfaces between the internal conductors and the surrounding magnetic ceramic through side surfaces of the magnetic ceramic element and the side gap sections such that the interfaces therebetween are separated with no gaps present at the interfaces therebetween and the metal is deposited on the surfaces of the internal conductors. Therefore, a multilayer coil component having high reliability can be efficiently manufactured.

When the side gap sections have a pore area percentage of less than 6%, it is difficult to allow the metal-containing acidic solution to reach the interfaces between the internal conductors and the surrounding magnetic ceramic such that the interfaces therebetween are separated with no gaps present at the interfaces therebetween and it is also difficult to deposit the metal on the surfaces of the internal conductors. When the side gap sections have a pore area percentage of greater than 20%, the amount of the metal deposited in the multilayer coil component is too large and therefore the risk of causing a short circuit is increased, which is not preferred.

In this example, description has been made using the case of manufacture by a sheet lamination process including a step of stacking the green ceramic sheets as an example. A magnetic ceramic slurry and the conductive paste for forming the internal conductors are prepared and manufacture can be performed by a so-called sequential printing process in which the magnetic ceramic slurry and the conductive paste are printed such that a laminate having the configuration described in this example is formed.

Alternatively, manufacture can be performed by a so-called sequential transfer process in which a ceramic layer formed by printing (applying) a ceramic slurry onto a carrier film is transferred to a table, an electrode paste layer formed by printing (applying) an electrode paste onto a carrier film is transferred to the ceramic layer, and this procedure is repeated such that a laminate having the configuration described in this example is formed.

A multilayer coil component according to exemplary embodiments can be manufactured by another method. A method for manufacturing the multilayer coil component is not particularly limited.

In the above exemplary embodiment, the metal films are deposited on surfaces of the internal conductors in such a manner that Ni electroplating is performed at a cathode current density of 0.30 (A/dm2) for 60 minutes. The metal films can be formed on surfaces of the internal conductors by an electroless plating process if conditions including a plating solution are adjusted.

In the above example, description has been made using the case of manufacturing the multilayer coil component one by one (the case of an individually manufactured product) as an example. For mass production, a large number of multilayer coil components can be simultaneously manufactured by the following process: for example, a large number of internal conductor patterns are printed on a surface of each of mother green ceramic sheets, an unfired multilayer block is formed in such a manner that the mother green ceramic sheets are stacked and then pressed, and the multilayer block is cut in accordance with the layout of the internal conductor patterns such that individual laminates for the multilayer coil components are cut out. That is, the multilayer coil components can be manufactured by a so-called multi-component manufacturing method.

Although in the above exemplary embodiment, the multilayer coil component has been described using a multilayer impedance element as an example, it will be appreciated that other embodiments can be applicable to various multilayer coil components such as multilayer inductors and multilayer transformers.

Embodiments consistent with the claimed invention can be applicable to multilayer inductors which partly contain a nonmagnetic ceramic and which have an open magnetic circuit structure.

Embodiments consistent with the claimed invention are not limited to the above exemplary embodiment in other terms. For example, various variations and modifications can be made for a method for distributing the metal films on surfaces of the internal conductors, a mode of distribution, a combination of a material for forming the metal films and a material for forming the magnetic ceramic layers, the size of a product, and/or conditions for firing the laminate (the unfired magnetic ceramic element) and be within the scope of the claimed invention.

According to embodiments consistent with the claimed invention, a multilayer coil component having high reliability can be obtained. The multilayer coil component includes magnetic ceramic layers and internal conductor layers and can solve a problem relating to the internal stress caused by the difference in firing shrinkage behavior between the magnetic ceramic layers and the internal conductor layers or by differences in thermal expansion coefficient therebetween without forming conventional gaps between the magnetic ceramic layers and the internal conductor layers. Furthermore, the migration of Ag contained in internal conductors can be suppressed. Thus, at the interfaces between internal conductors and the magnetic ceramic, these materials are just in contact without gaps, but are separated (i.e., without chemical bonding).

Therefore, embodiments consistent with the claimed invention can be widely applied to various multilayer coil components such as multilayer inductors, multilayer transformers, and multilayer impedance elements having a configuration in which a coil is disposed in a magnetic ceramic.

Although a limited number of exemplary embodiments of the claimed invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. A multilayer coil component comprising:

plural internal conductors made of Ag provided between adjacent magnetic ceramic layers and interconnected to each other to form a helical coil surrounded by magnetic ceramic; and metal films on surfaces of the internal conductors, wherein no gaps are present at interfaces between the internal conductors including the metal films and the surrounding magnetic ceramic, and the interfaces between the internal conductors and the magnetic ceramic are separated, portions of the magnetic ceramic that are located in side gap sections of the magnetic ceramic that are regions between side portions of the internal conductors forming the helical coil and side surfaces of the magnetic ceramic have a pore area percentage of 6% to 20%, and the metal films on the surfaces of the internal conductors are distributed in such a state that pores present in the magnetic ceramic layers around the internal conductors are filled with the metal films.

2. The multilayer coil component according to claim 1, wherein the magnetic ceramic is made of NiCuZn ferrite.

3. The multilayer coil component according to claim 1, wherein the magnetic ceramic is made of NiCuZn ferrite.

4. The multilayer coil component according to claim 2, wherein the magnetic ceramic contains low-softening point zinc borosilicate glass having a softening point of 500° C. to 700° C.

5. The multilayer coil component according to claim 4, wherein a metal contained in the metal films is Ag that is the same as a metal contained in the internal conductors or at least one selected from the group consisting of Ni, Pd, Au, Cu, and Sn that are dissimilar metals.

6. The multilayer coil component according to claim 5, wherein the metal contained in the metal films has a thermal expansion coefficient that is less than that of Ag contained in the internal conductors and is greater than that of a magnetic material contained in the magnetic ceramic layers.

7. The multilayer coil component according to claim 6, further comprising external electrodes and plating layers disposed on the internal conductors, the external electrodes being disposed on surfaces of the magnetic ceramic element and being electrically connected to the internal conductors, wherein the metal contained in the metal films is the same as a metal contained in at least one portion of each plating layer.

8. The multilayer coil component according to claim 3, wherein the magnetic ceramic contains low-softening point zinc borosilicate glass having a softening point of 500° C. to 700° C.

9. The multilayer coil component according to claim 8, wherein a metal contained in the metal films is Ag that is the same as a metal contained in the internal conductors or at least one selected from the group consisting of Ni, Pd, Au, Cu, and Sn that are dissimilar metals.

10. The multilayer coil component according to claim 9, wherein the metal contained in the metal films has a thermal expansion coefficient that is less than that of Ag contained in the internal conductors and is greater than that of a magnetic material contained in the magnetic ceramic layers.

11. The multilayer coil component according to claim 10, further comprising external electrodes and plating layers disposed on the internal conductors, the external electrodes being disposed on surfaces of the magnetic ceramic element and being electrically connected to the internal conductors, wherein the metal contained in the metal films is the same as a metal contained in at least one portion of each plating layer.

12. The multilayer coil component according to claim 1, wherein a metal contained in the metal films is Ag that is the same as a metal contained in the internal conductors or at least one selected from the group consisting of Ni, Pd, Au, Cu, and Sn that are dissimilar metals.

13. The multilayer coil component according to claim 1, wherein the metal contained in the metal films has a thermal expansion coefficient that is less that of Ag contained in the internal conductors and is greater than that of a magnetic material contained in the magnetic ceramic layers.

14. The multilayer coil component according to claim 1, further comprising external electrodes and plating layers disposed on the internal conductors, the external electrodes being disposed on surfaces of the magnetic ceramic element and being electrically connected to the internal conductors, wherein the metal contained in the metal films is the same as a metal contained in at least one portion of each plating layer.

* * * * *